United States Patent [19]

Schaufeld

[11] Patent Number: 4,874,187

[45] Date of Patent: Oct. 17, 1989

[54] INSURANCE FORM PACKET

[75] Inventor: Fredrick Schaufeld, Washington, D.C.

[73] Assignee: National Electronics Warranty Corporation, Washington, D.C.

[21] Appl. No.: 105,045

[22] Filed: Oct. 6, 1987

[51] Int. Cl.[4] ..... B42D 15/00; B42D 15/02; B65D 85/00; A47B 97/02

[52] U.S. Cl. ..... 283/70; 283/74; 220/444; 312/183

[58] Field of Search ..... 283/54, 70, 74, 79, 283/109, 42; 312/183; 220/444, 443, 453; 281/38; 402/79; 229/92.8; 40/159

[56] References Cited

U.S. PATENT DOCUMENTS

| | | | |
|---|---|---|---|
| 3,124,292 | 3/1964 | Stegner | 220/444 |
| 3,495,756 | 12/1970 | Achermann et al. | 220/444 |
| 3,794,550 | 2/1974 | Taillie | 402/79 |
| 3,930,700 | 1/1976 | Figueres | 312/183 |
| 4,175,777 | 11/1979 | Horn | 283/42 |
| 4,469,353 | 9/1984 | Anarwala | 283/74 |
| 4,545,838 | 10/1985 | Minkus | 283/109 |
| 4,549,750 | 10/1985 | Stone et al. | 283/79 |
| 4,616,854 | 10/1986 | Landrum et al. | 283/74 |
| 4,626,669 | 12/1986 | Davis et al. | 283/70 |

OTHER PUBLICATIONS

PTO Form 270 Package Oct. 1984.

*Primary Examiner*—Frank T. Yost
*Assistant Examiner*—Paul M. Heyrana, Sr.
*Attorney, Agent, or Firm*—Banner, Birch, McKie & Beckett

[57] ABSTRACT

The invention comprises at least one page of information, a rigid support material with slightly deformable edges, and a transparent viewing enclosure. Placing insurance data on the form provides a method for inventory control of "soft" insurance products such as extended warranty contracts.

11 Claims, 1 Drawing Sheet

FIG. 1
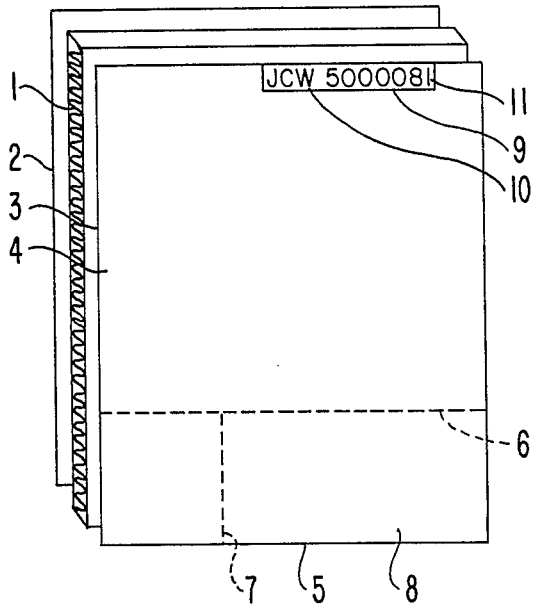
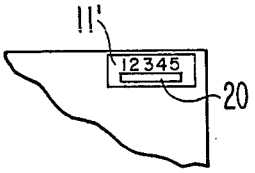
FIG. 2a
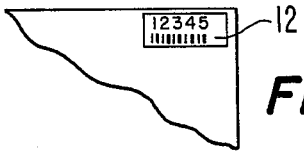
FIG. 2
FIG. 3
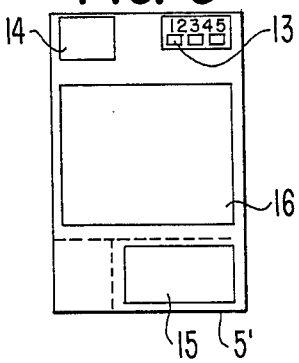
FIG. 4
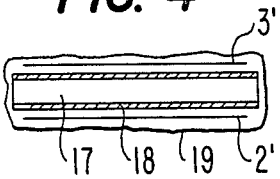

INSURANCE FORM PACKET

BACKGROUND OF THE INVENTION

Disclosed is an insurance form comprising one or two pages of information, an optional detachable card on one of the pages, a stiff but slightly deformable support material disposed behind or between the pages, and an enclosure for viewing the information on each page.

Also described is a method for inventory control of insurance forms which is suited to use of the above insurance form package.

DESCRIPTION OF RELATED TECHNOLOGY

Insurance forms have taken a variety of different structures. See, for example, U.S. Pat. Nos. 853,852; 1,522,530; 3,930,700; and 4,616,854.

Insurance forms and extended warranties have been sold as a plurality of attached forms with carbon-coated paper disposed between sheets. These forms are packaged as a stack or box of individual forms. Necessarily, a purchaser of the insurance or warranty service does not see the terms of the contract until after contacting a sales representative. The purchaser must read the terms as the representative waits. This situation makes most people uncomfortable and deters them from reading the terms carefully or inquiring about the service in the first place.

The flexible sheet form of the contracts also makes inventory control difficult. Flexible forms can be folded and easily removed from the store within pockets or clothing. If each form is not numbered or otherwise coded, the only way to determine if forms are missing is to manually count the remaining forms and compare the inventory with the number ordered.

The counting is relatively slow due to the flexible nature of the form. Each form must be separated from the pile and removed. This procedure causes one form to slide over another introducing the possibility of tearing any of the pages or wearing away the words.

SUMMARY OF THE INVENTION

By contrast to the procedure with flexible forms, the invention uses a form that is easier to count and control. The insurance form of the invention comprises a relatively stiff center material behind a front sheet or between front and back sheets containing the required information. The term "relatively" is based on a comparison with a single sheet of thin cardboard of about one-sixteenth inch (0.0625 inches) thickness for reasons explained below. Preferably, the center material is slightly deformable at its edges yet rigid through it length. The most preferred center material is corrugated or solid cardboard of at least one-eighth inch (0.125 inches) thickness or a material known by the trademark FOAMCORE. The FOAMCORE material comprises a foamed plastic material disposed between thin cardboard sheets. The total thickness of FOAMCORE is varied but most common in a thickness of about one-fourth inch (0.25 inches).

A detachable card may be attached to or within one or more of the sheets.

One or both of the sheets may be uniquely coded by a means for coding such as sequential numbers, bar codes, colors, magnetic information, alphabetical letters, or combinations thereof.

A viewing enclosure restrains at least one of the forms against the relatively stiff center material. Preferably, two pages are used and one form is on either side of the center material. The viewing enclosure is designed to display the displayed portions on each form. One form of enclosure uses an envelope of appropriate size with transparent panels of a plastic material, e.g. cellophane. Another and more preferred enclosure material is a transparent or substantially transparent polymeric material that is sealed by heat and which will shrink dimensionally when mildly heated. Such a material is best exemplified by a wrapping material known as SHRINK WRAP. This material is a clear plastic material, available in rolls, and shrinks in width and length when heated above about 150 F. "Substantially transparent" is meant to encompass polymeric materials that are slightly translucent yet permit a viewer to read printed data through the material.

When the shrinking plastic material is used, the shrinking process exerts a force on the center material. If the material is not rigid enough, this force will cause the support material to bend and curl until the pressure is relieved. The corrugated cardboard or FOAMCORE material discussed above are sufficiently rigid to withstand the bending forces. If only rigidity were required, one might consider using a material of absolute rigidity such as a pane of glass, wood, stone. None of these materials is practical, though, due to their sharp edges which would break the enclosure material. The cost and weight of these materials are also prohibitive for economic use.

The insurance form will have certain information on at least one of the pages. For example: (1) a pattern area comprising data means for representing the identity of the insurance company and the address of the insurance company against which the claim is filed; (2) a pattern area comprising data means for identifying an insurance claimant's name and address; (3) a pattern area comprising means for identifying that particular form; (4) a pattern area comprising data means for identifying the act or acts which activate the right to file a claim; (5) a pattern area comprising data means for later reference which identifies the limitations of the claimant's right to file a claim, e.g. the particular item or person insured; and (6) a detachable pattern area comprising data means for identifying the data means within the first through fifth areas when said detachable pattern area is removed from said form and given to said insurance company. For extended service warranty insurance forms, the data means for identifying the acts which activate the right to file a claim will include a listing of the items that may be covered with appropriate means for indicating for which item coverage is desired.

The inventory control method of the invention relies on using an insurance form as described above. The rigid support material and clear viewing enclosure facilitate packaging, transportation, coding, theft prevention, and display. The theft prevention aspect of the invention goes hand in hand with the advantageous display characteristics of the insurance form. One may display the insurance form for the potential buyer's convenience yet avoid the concerns associated with theft of the form.

One may also sell the insurance forms as an item having value rather than as an application for a service. The distinction eliminates the need for subsequent contact by the insurance company to quote the price of the insurance services. The insurance product is thus transformed into a "hard" product which may be placed into an inventory.

Individualized form coding also allows accurate record keeping and a means for tracing each form to a particular sales location. In this way, claimants who steal the insurance form would be unable to register a valid claim. The particular form on which the claim would be based would not have a corresponding sales record. Matching the sales records to the claim form submitted by a claimant is easily accomplished by an appropriate cross referencing system, for example, a computer network with appropriate programming.

The overall size of the insurance form is infinitely variable. Preferably, the form uses a standard paper size such as letter size (8½"×11"), international "A4" size (about 8"×13"), and legal size (8½"×14").

The rigid support material should be at least the same size as the sheet or sheets containing the data areas described above. The support material size will be determined by the type of enclosure material used. If a transparent shrinking plastic is used, the support material should be the same size or just slightly larger than the sheet or sheets. This size avoids bending the information sheet or sheets.

The invention has been described with reference to insurance forms yet the invention may be used for other types of "soft" products. For example, stock certificates, bearer bonds, municipal note shares, and other "paper" interests may use the form of the invention. The first through fifth areas will contain similar data to those described above. The sixth data area would be optional depending on the record keeping method used. Accordingly, the terms used to describe the above first through sixth data areas should be considered as generic to describing similar data areas, e.g. "insurance company" should be considered as embracing a description of a "stock issuing company" for purposes of this invention.

BRIEF DESCRIPTION OF THE DRAWINGS

FIG. 1 shows an exploded view of the insurance form without the transparent enclosure material.

FIGS. 2 and 2*a* illustrate various means for coding the insurance form of the invention.

FIG. 3 depicts another means for coding the form in addition to one embodiment of data pattern arrangement.

FIG. 4 shows an exploded view of the insurance form including the transparent enclosure material.

DETAILED DESCRIPTION OF THE DRAWINGS

FIG. 1 shows rigid support material 1 between two pages 2,3 of data. Pattern areas comprising data means 4 for desired information are arranged on the exterior faces of pages 2 and 3. Detachable card 5 is formed from page 3 by lines of weakening 6 and 7. Pattern area 8 lies on the exterior face of card 5. Additional pattern areas (not shown) may be on the interior of page 3 and, in particular, on the interior of card 5. The pattern data will preferably comprise sufficient information for identifying the name and address of the insurance company.

Coding means 9 comprises alphabetical letters 10 and numerals 11.

FIG. 2 depicts a bar code 12 as a means for coding. FIG. 2*a* shows the use of numerals 11' and a magnetic strip 20 comprising coding information.

FIG. 3 illustrates colored areas 13 in addition to numerals for coding the form. The name and address of the insurance company lies within pattern area 14. Means for identifying the name and address of the insurance claimant is in pattern area 15 on detachable card 5'. Means for describing the terms and conditions for filing a claim, such as a listing of items for which extended service warranty coverge is desired, is within pattern area 16.

FIG. 4 shows an exploded view another embodiment of the invention. Foamed plastic material 17 between thin cardboard sheets 18 serves as the rigid support material with deformable edges. Heat shrinking plastic enclosure material 19 surrounds support material 17,18 and pages 2',3'. The individual components are shown axially separated for ease of illustration only. In practice, enclosure 19 will shrink in length and width to firmly enclose and abut pages 2' and 3' against support material 17,18.

Please note that the drawings are not drawn to any particular scale. They are illustrative of the many variations contemplated within the scope of the invention.

What is claimed is:

1. An insurance form comprising:

two sheets of printed information at both sides of a stiff support, at least one of said sheets having at least one line of weakening;

said stiff support material of at least about ⅛ inch thickness with deformable edges of at least the same size as said two printed sheets, and a transparent or substantially transparent viewing enclosure means for restraining said two sheets of printed information against said support material and for viewing at least a portion of said information.

2. An insurance form according to claim 1 wherein said support material comprises corrugated cardboard.

3. An insurance form according to claim 1 wherein said support material comprises a foamed plastic between two sheets of cardboard.

4. An insurance form according to claim 1 wherein said at least one sheet of printed information comprises a means for coding said insurance form.

5. An insurance form according to claim 4 wherein said means for coding comprises at least one number.

6. An insurance form according to claim 5 wherein said means coding further comprises an identifying color.

7. An insurance form according to claim 5 wherein said means for coding further comprises a bar code.

8. An insurance form according to claim 5 wherein said means for coding further comprises at least one alphabetical letter.

9. An insurance form according to claim 1 wherein said at least one sheet of printed information comprises:

a first pattern area comprising data means for representing the identity and address of the insurance company, and a second pattern area comprising data means for identifying a name and address of an insurance claimant.

10. An insurance form according to claim 9 wherein said at least one sheet of printed information further comprises:

a third pattern area comprising data means for identifying the terms and conditions of filing a claim.

11. An insurance form according to claim 1 wherein said two sheets of printed information exhibits a size between 8½ inches by 11 inches and 8½ inches by 14 inches.

* * * * *